United States Patent [19]

Adler

[11] 3,994,238

[45] Nov. 30, 1976

[54] RAILWAY HOPPER CAR WITH BOTTOM DOOR DISCHARGE MECHANISM

[75] Inventor: Franklin P. Adler, Michigan City, Ind.

[73] Assignee: Pullman Incorporated, Chicago, Ill.

[22] Filed: June 27, 1975

[21] Appl. No.: 591,190

[52] U.S. Cl. ..... 105/241 C; 105/299; 105/304; 214/58; 214/63

[51] Int. Cl.[2] ..... B61D 7/30

[58] Field of Search ..... 214/58, 63; 105/241 C, 105/251, 286–290, 299, 304

[56] References Cited

UNITED STATES PATENTS

| | | | |
|---|---|---|---|
| 3,452,886 | 7/1969 | Dorey | 214/63 |
| 3,459,317 | 8/1969 | Shaver | 214/63 |
| 3,474,920 | 10/1969 | Miller | 214/63 |
| 3,872,796 | 3/1975 | Adler et al. | 105/304 |

OTHER PUBLICATIONS

B555,772, Jan. 1976, Miller, 214/58.

*Primary Examiner*—Stephen G. Kunin
*Assistant Examiner*—Jesus D. Sotelo
*Attorney, Agent, or Firm*—Richard J. Myers

[57] ABSTRACT

A bottom door discharge mechanism for a railway hopper car includes a bell crank arm for each of the doors located in pairs at the bottom of the hopper. The arms are tripped from track side cams on opposite sides of the car for movement to open and closed positions. A safety locking mechanism is provided which during transit positively locks the arms against rotation to an open position. The locking mechanism includes arms or cam followers which are actuated from the track side opening cam thereby disengaging said locking mechanisms just prior to engagement of a second cam follower with said track side cam whereupon the bell crank levers are actuated to move the doors to their open position.

10 Claims, 7 Drawing Figures

RAILWAY HOPPER CAR WITH BOTTOM DOOR DISCHARGE MECHANISM

A related application is Ser. No. 415,098 filed Nov. 12, 1973, now U.S. Pat. No. 3,872,796.

BACKGROUND OF THE INVENTION

1. The Field of the Invention

This invention relates to hopper cars and particularly to those which include pairs of bottom discharge doors which are opened in response to track side operating mechanisms.

2. Description of the Prior Art

The prior art is well represented by U.S. Pat. Nos. 1,266,630 May 21, 1918; 1,803,384 May 5, 1931; 3,314,558 Apr. 18, 1967 and 3,459,317 Aug. 5, 1969. The present invention sharply distinguishes from the prior art in that it provides a positive opening mechanism for a bottom door arrangement and also assures that positive locking of the doors until they reach a side of the track camming mechanism which disengages a safety lock mechanism and sequentially trips the doors to an open position.

SUMMARY OF THE INVENTION

The present invention provides an improved bottom door opening mechanism for hopper cars of the type which generally carry comminuted materials such as coal, grain, ore, and other similar materials. For each of the doors positioned beneath a hopper there is provided a bell-shaped crank arm which is connected by means of links to the door and which is moved by means of a camming device to an over-center position. In the over-center position each door is closed and each arm is held in this position firmly by means of an auxilliary locking mechanism which prevents movement of the arm in an unlocking direction. The arm includes a cam engageable element which engages an opening cam thereby moving the arm from the over-center position. Just prior to the engagement of said cam engageable element with the opening cam, a cam follower is moved by the cam to a position whereby the said cam follower moves a locking element to an unlocked position so as to permit the arm to then be moved by the opening cam to its opened position. When the arm is again moved to a closed over-center position, the auxilliary locking mechanism again engages the arm to lock the arm in the locked position.

DESCRIPTION OF THE PREFERRED EMBODIMENT

In the above related patent application, Ser. No. 415,098 filed Nov. 12, 1973, an improved door operating mechanism for railway hopper cars is disclosed. The present invention includes a door opening and closing actuating device which is also disclosed in the aforementioned application and further includes an improved arrangement for actuating the opening and closing mechanism from cams located adjacent the railway track side.

Figure 1:
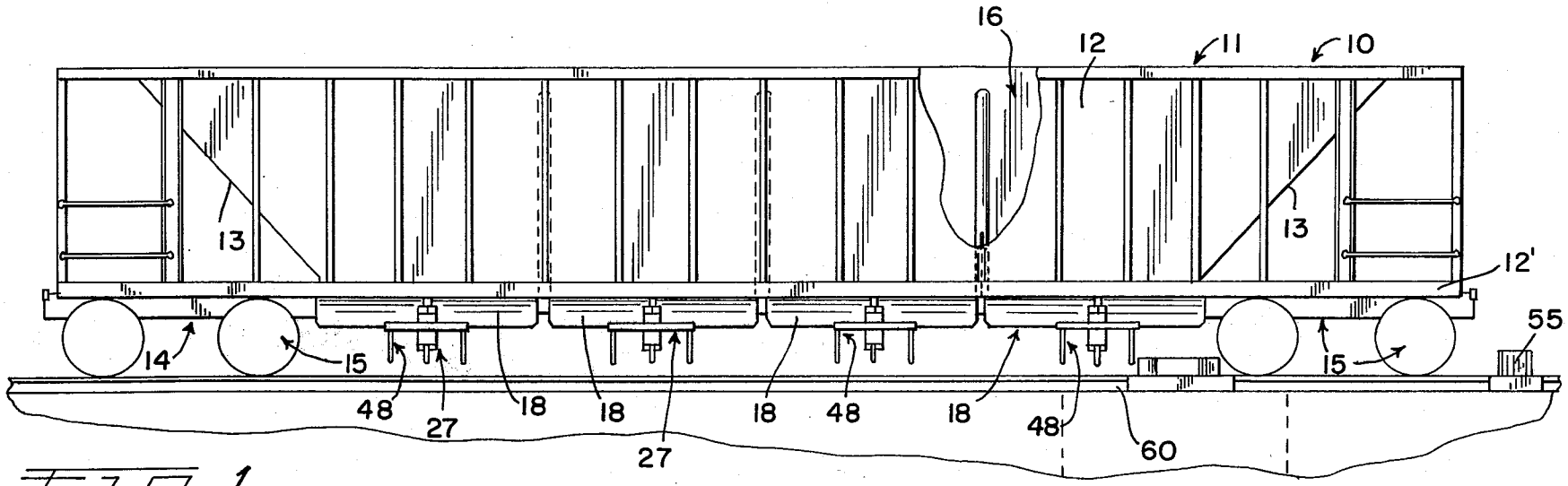
FIG. 1 is a side elevational view of a railway hopper car positioned on a railway track.

Referring now particularly to FIG. 1, a railway hopper car 10 includes body 11 provided with sidewalls 12 having at their lower ends sidesills 12'. End walls 13 are provided opposite ends of body 11 and the body 11 is supported on an underframe 14 in turn supported on conventional car trucks 15. The present car includes a number of hoppers 16 which are separated by means of vertical walls 17 as best shown in FIG. 1. For each of the hoppers 16 there is provided a pair of discharge gates or doors 18 which are individually opened from track side cam mechanisms to be described. Each of the hoppers is formed with slope sheets 19 at the lower end of which there are provided hopper discharge openings 20 which are suitably closed by the discharge doors 18.

Each of the discharge doors 18 includes bottom sheets 21 and is provided with longitudinally extending beams 22 suitably interconnected with the bottom sheets 21 to provide a rigid door structures. Each of the doors 18 is pivotally mounted and connected to the lower ends of the hopper sheets 19 by means of pivot brackets 23 in turn supported by means of pivot shafts 24 which are journaled on end support brackets 25 on opposite sides of the hopper car. A central support bracket 26 suitably supports a door actuating mechanism generally designated at 27. The door actuating mechanism 27, which is provided for each door, includes a bell-shaped crank lever or arm 28 having an inwardly extending arm or extension 29. A stop bracket 30 is connected to the extension or arm 29 and is provided with a recess 31 which in the open position of the door shown in FIG. 4 receives one end of the door in supporting relation. A link 32 is pivotally connected to the stop bracket 30 by means of a pivot pin 33 and also pivotally supports a link 32 which is pivotally connected by means of a pin 34 to the door 18. The bell-crank lever or arm 28 is also provided with an upright arm 35. The arm 28 is connected by means of a pivot shaft 36 to the central support bracket 26. The arm 35 is suitably connected to the central support brackets 26 by means of a spring biased link connector 37 comprising a pair of telescoping tubular link members 38 and 39. The telescoping link members 38 and 39 provide housing for a spring 40. A pivot pin 41 pivotally connects the link member 38 to the arm 35 and the link member 39 is pivotally connected to the bracket members 26 by means of a pivot 42. A pivoted lever element 43 is disclosed and the function of this element is further described in the aforementioned patent application.

Figure 2:
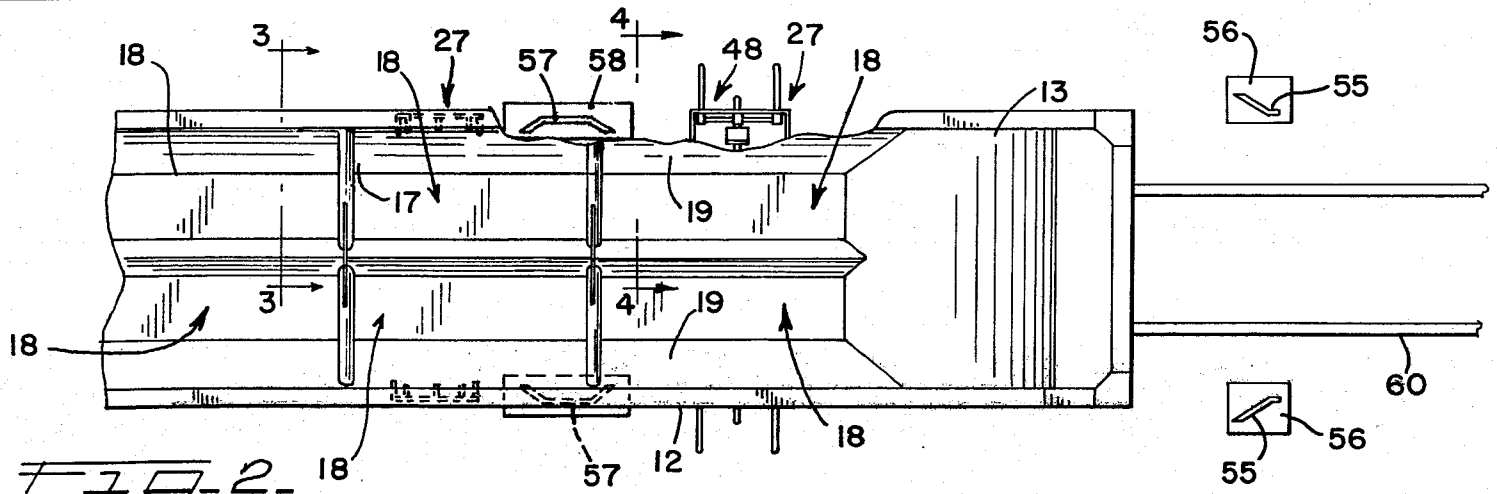
FIG. 2 is a plan view of a portion of the car shown in FIG. 1.
Figure 3:
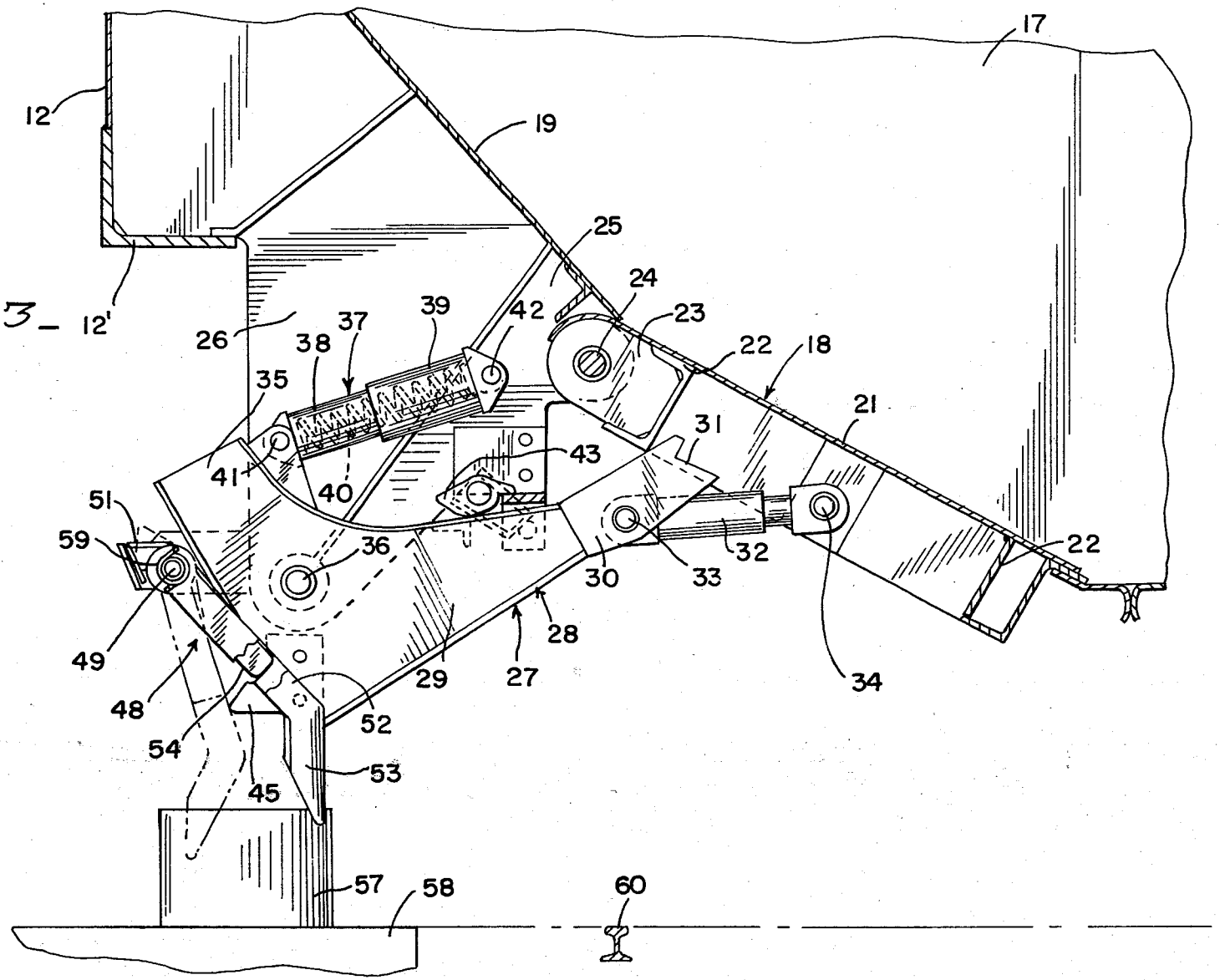
FIG. 3 is a cross sectional view taken substantially along the line 3—3 of FIG. 2 disclosing a closed position of a hopper car door and its actuating mechanism.
Figure 4:
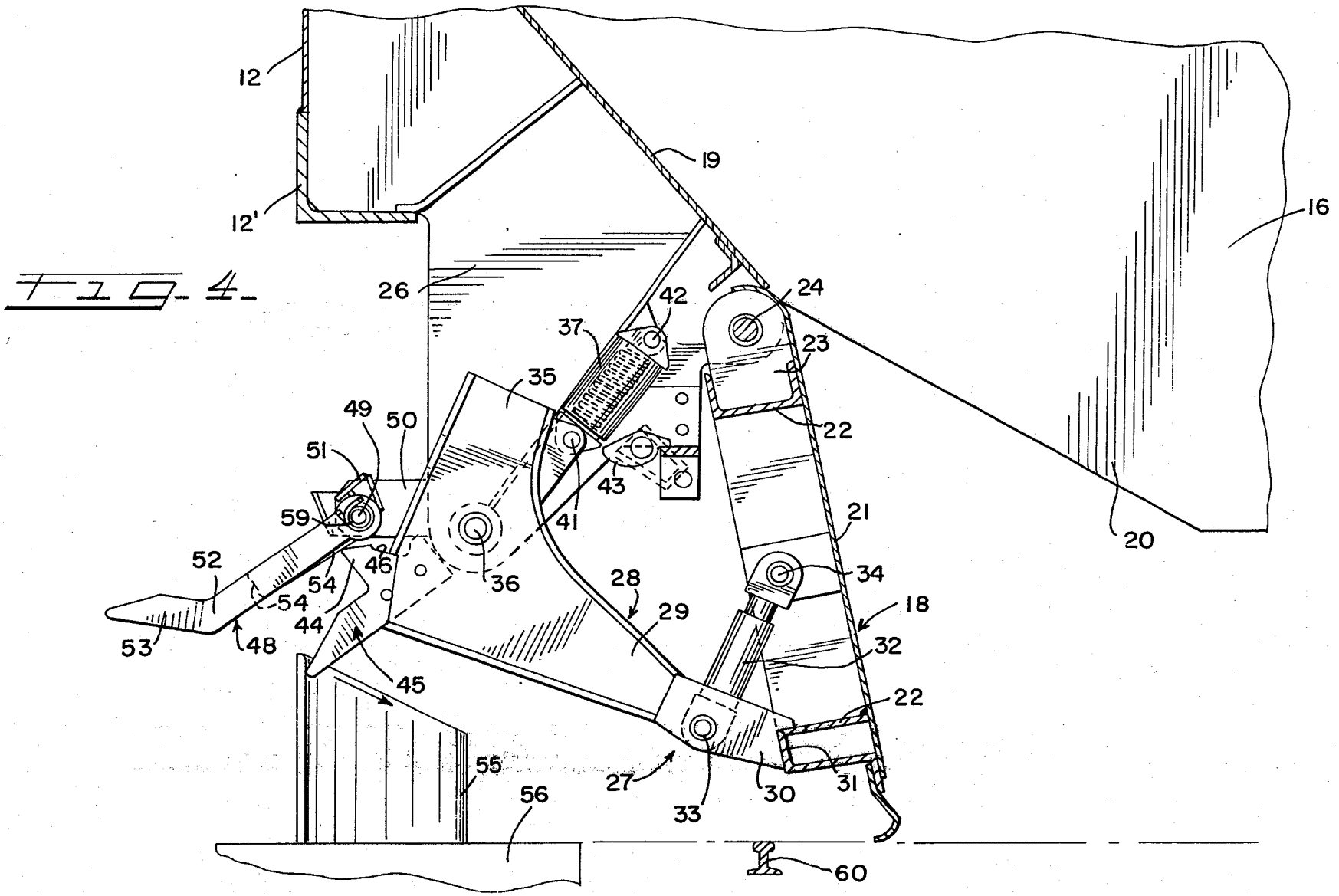
FIG. 4 is a cross sectional view taken substantially along the line 4—4 of FIG. 2 showing an open position of a hopper car door and its associated actuating mechanism.
Figure 5:
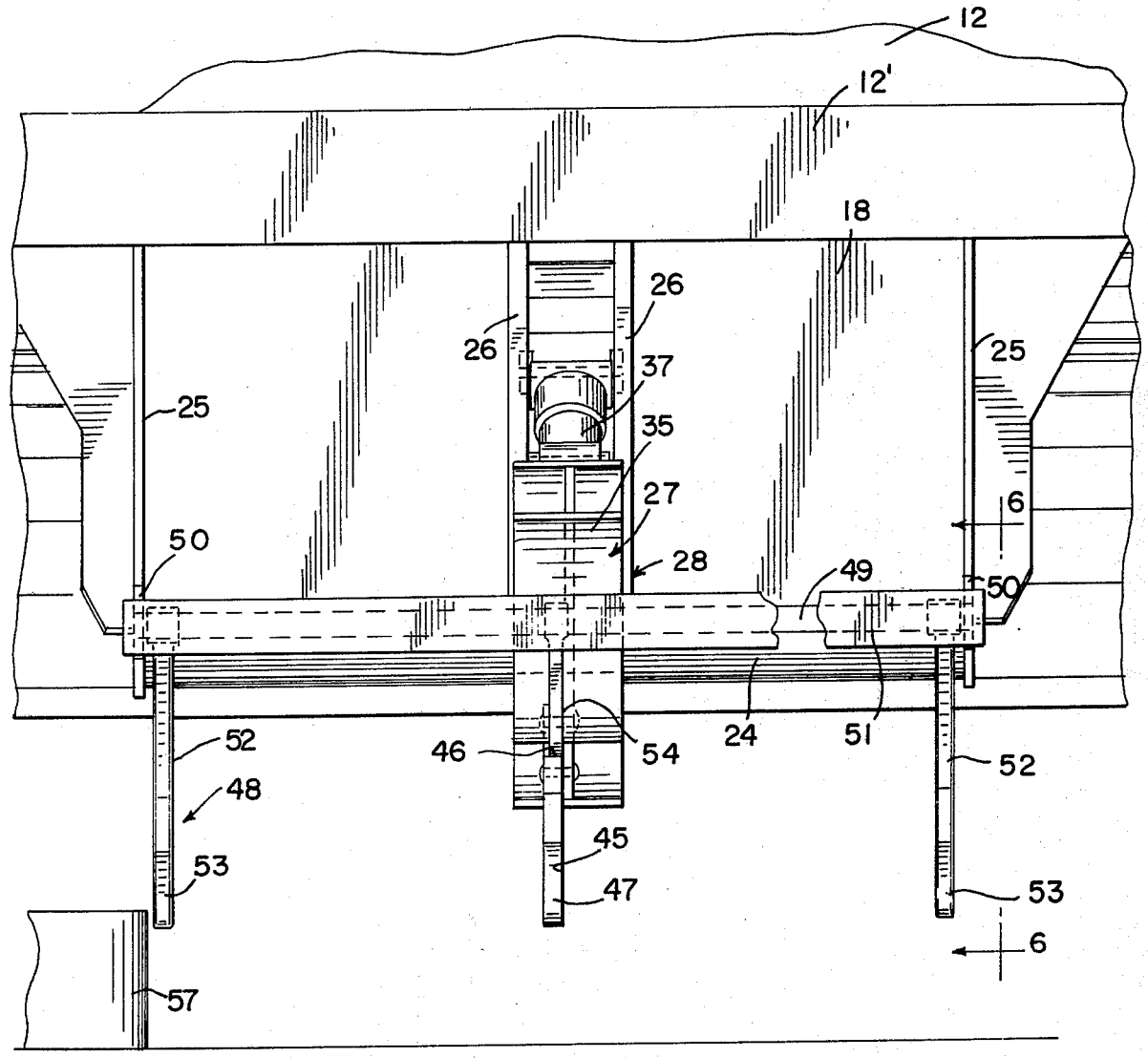
FIG. 5 is an enlarged side elevational view of a hopper car door actuating mechanism associated with a hopper.
Figure 6:
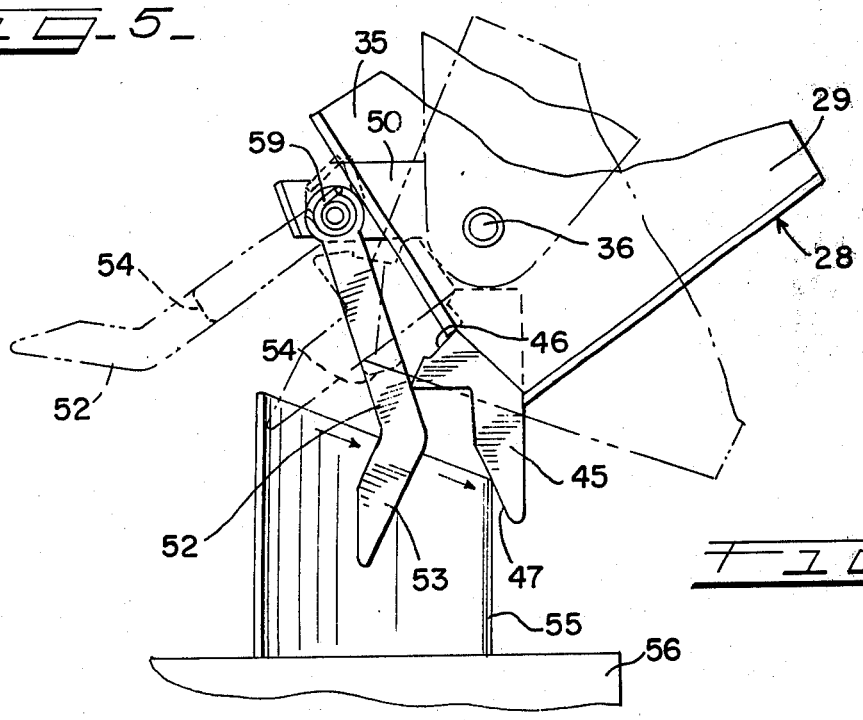
FIG. 6 is a side elevational view taken substantially along the line 6—6 of FIG. 5 showing various positions of a cam follower having engaged a closing cam for closing a hopper door.

A cam engaging member 45 is rigidly secured to the lower end of the arm 35 of the bell-crank 28. The cam engaging member 45 includes a projecting finger 44 which includes an undercut portion 46 and is provided at its lower end with a cam engaging edge 47. As best shown in FIGS. 3, 4, and 5, a releasable lock mechanism is generally designated at 48. The lock mechanism 48 includes a shaft 49 which is journaled on bracket extensions 50, in turn supported on the end support brackets 25. A longitudinally connector bracket 51 is connected to outrigger arms or cam followers 52 which in turn are pivotally supported on the shaft 49 for conjoint movement as will be described. Each of the cam followers 52 includes cam engagable ends or surfaces 53. Connected to conjoint movement with the outrigger arms 52 is a lock arm 54 which as best shown in FIG. 3 is in the engaging position within the undercut keeper 46 thereby preventing inadvertant rotation of the bell-shaped crank 28 from the over-center position disclosed. Closure cams 55 are supported on bases 56 and are positioned on opposite sides of the car as best shown in FIG. 2. The opening cams 57 also are supported on bases 58 on opposite sides of the car as shown in FIG. 2. A coil spring 59 is suitably connected to each of the arms 52 and has one of its springs ends rigidly anchored to continually bias the arms 52 in a counter-clockwise direction to the position shown in FIG. 3. The railway car also is supported on a suitable railway track 60 alongside which each of the cams 55 and 57 are positioned.

OPERATION

In FIGS. 1 and 2 the railway car 10 may be considered as moving from left to right on the track 60. As best shown in FIG. 2, the opening cams 57 are positioned between hoppers and the first hopper door and the door arrangement for the first hopper has already been opened to an open position by the opening cam. The door actuating mechanism 27 for the next hopper is now in position as the car moves along to the right wherein one of the outrigger arms of each of the mechanisms is now engagable with the opening cam 57 whereupon the arm 52 is moved outwardly from the position shown in FIG. 3 to the dotted line position whereby the lock element 54 is rotated with the shaft and arms 46 outwardly from the keeper surface 52 of the cam engaging member 45. Immediately thereafter, in sequence, the element 45 engages the opening cam 57 which thereupon rotates the bell-crank arm 28 out of the over-the-center position shown in FIG. 3 and to the open position which is shown in FIG. 4. As each arm 28 is rotated the doors 18 are cracked open and the load within the hopper by gravity further forces the doors immediately downwardly and the load is discharged. The spring link 37 as described in the aforementioned application and the pivoted lever or cam 43 perform a function which is more fully described in the aforementioned application.

In FIG. 4 the door 18 is now in a position ready to be closed by the closing cam 55. As the car runs along the track, the element 45 engages the cam 55 thereby forcing the bell-crank arm 28 to pivot in a counter-clockwise direction in turn closing the door which is then again locked by means of the over-center relation of the link 32 to the arm 28 and its pivoted point 36 as best shown in FIG. 3. It will be noted in FIG. 4 that the tip portion 44 of the cam engaging member 45 is in engagement with the lock arm 54 and which holds the lock arm 54 and the outrigger arms 52 in the position shown in FIG. 4 against the action of the coil spring 59 which seeks to bias the outrigger arms to the inward locked position. Thus, when the arm or lever 28 is in the open position, it also maintains the lock element 54 outwardly until the arm again is in the closed position wherein the lock element 54 is then moved in a counter-clockwise direction back into its engaged position with the keeper seat 46 on the cam engaging member 45.

Figure 7:
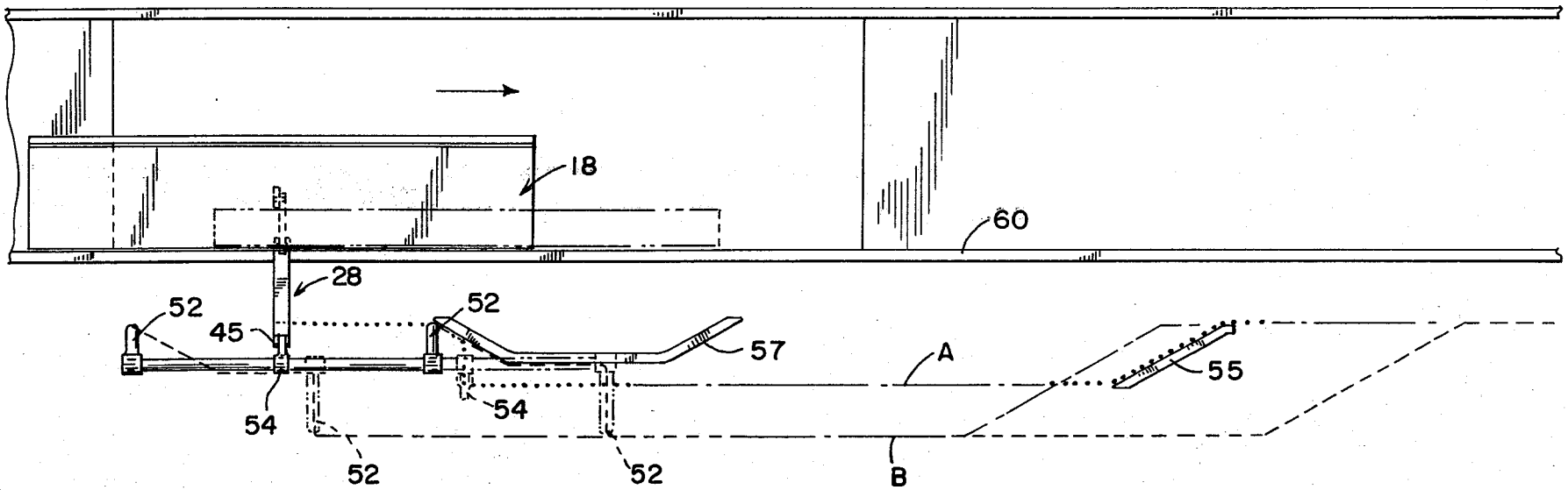
FIG. 7 is a schematic view disclosing a sequence in the operation of an opening and a closing cam for actuating a door mechanism.

The sequence of operation is well disclosed in FIG. 7 which schematically indicated the movement of the relative members. As the car moves in the direction of the arrow to the right on the track 60, the first outrigger arm 52 engages the opening cam 57 and thereupon the arm 52 is swung outwardly which in turn disengages the lock arm 54 from its engaged position with respect to the cam engaging member 45. The broken dash line B show the movement of the outrigger arms 52 and the dotted line A show the movement of the cam engaging member 45. The cam engaging member 45 then sequentially engages the opening cam 57 and the doors are moved to an open position. After the material has been discharged and the car moves along the track, the cam engaging element then engages the closing cam 55 thereupon closing the moving crank arms to a closed position whereupon the outrigger arms 52 can then again swing to a closed position as forced by the spring 59 and the lock element 54 again engages the member 45 to lock the same in position.

Thus, it is clear that an improved cam opening and cam closing arrangement has been described which also functions to actuate an auxilliary lock sequentially in response to movement of the cam, related cams and related elements.

What is claimed is:

1. In a railway hopper car having a body structure and a hopper bottom dump door means movable between closed and open positions for discharging material from said hopper, door actuating mechanism including an L-shaped arm pivotally mounted on each hopper for pivotal movement about a longitudinal axis, said arm including an upright portion and a laterally extending portion, said door means including a door pivoted on said hopper for downward movement to an open position, means connecting said laterally extending arm portion to said door whereby during pivotal movement of said arm in one direction said door is opened and when pivotally moved in an opposite direction said door is closed, the improvement comprising;

a cam engaging member connected to said arm and projecting outwardly with respect thereto, a cam edge on said member, an opening cam positioned adjacent the railway on which said car is moving, said cam including a cam surface engaged by said cam edge during car movement whereby said cam engaging member is moved to pivot said arm in said one direction, a closing cam spaced longitudinally from said opening cam having a cam surface engaged by said cam edge during continued car movement to pivot said arm in said opposite direction to close said door, a releasable lock mechanism supported on said hopper for locking said door in said closed position including, a lock element movable into and out of engagement with said arm for respectively locking and unlocking said arm against pivotal movement, a cam follower connected to said lock element, said cam follower being movably supported on said hopper, said follower being longitudinally spaced in front of said cam engaging member in the direction of movement of said car, whereby said follower engages said opening cam to unlock said lock element prior to said movement of said arm in said one direction by said engagement of said cam engaging member with said opening cam.

2. The invention in accordance with claim 1, including means biasing said cam follower to a non-engaging position when said lock element is in a lock position.

3. The invention in accordance with claim 1, said releasable lock mechanism including a rotatable shaft connected to said lock element and said cam follower, said shaft being supported on said hopper for rotating movement about a longitudinal axis.

4. The invention in accordance with claim 3, said cam engaging member including a keeper seat and said lock element being seated on said seat during the lock position.

5. The invention in accordance with claim 1, said lock mechanism including a second cam follower connected to said lock element, said first mentioned cam follower and second cam follower being positioned on longitudinally spaced opposite sides of said lock element.

6. The invention in accordance with claim 3, including spring means for rotating said shaft in a direction locking said element relative to said arm.

7. The invention in accordance with claim 1, said cam follower including a lever having a cam engaging lower portion.

8. The invention in accordance with claim 1, said cam follower being longitudinally spaced from said cam engaging member a sufficient distance whereby said cam follower disengages said lock element from said lock position prior to engagement of said cam engaging member with said opening cam.

9. The invention in accordance with claim 3, including spring means biasing said shaft to return said lock element to a lock position.

10. The invention in accordance with claim 9, said cam engaging member having a portion engaging said lock element for maintaining the same in an unlock position against the biasing action of said spring means during camming engagement of said cam engaging member with said opening cam.

* * * * *